United States Patent [19]

Venner et al.

[11] Patent Number: 4,938,941

[45] Date of Patent: Jul. 3, 1990

[54] PARTIALLY CARBONIZED POLYMERIC FIBROUS MATERIAL HAVING AN ELECTRICAL RESISTIVITY OF ENHANCED STABILITY

[75] Inventors: Jozef G. Venner, Matthews; Yoon S. Ko, Charlotte, both of N.C.

[73] Assignee: BASF Aktiengesellschaft, Fed. Rep. of Germany

[21] Appl. No.: 327,533

[22] Filed: Mar. 23, 1989

Related U.S. Application Data

[62] Division of Ser. No. 786,863, Oct. 11, 1985, Pat. No. 4,816,242.

[51] Int. Cl.[5] ..... D01F 9/12

[52] U.S. Cl. ..... 423/447.2; 423/447.1; 423/447.6; 423/447.9; 423/449; 8/115.51; 8/115.54; 8/115.55; 8/115.69

[58] Field of Search ..... 423/447.1, 447.2, 447.4, 423/447.6, 447.9, 449; 8/115.51, 115.54, 115.55, 115.69; 428/367

[56] References Cited

U.S. PATENT DOCUMENTS

| | | | |
|---|---|---|---|
| 3,285,699 | 11/1966 | Tsunoda | 423/447.6 |
| 3,497,318 | 2/1970 | Noss | 423/447.5 |
| 3,607,059 | 9/1971 | Joo et al. | 8/115.51 |
| 3,745,104 | 7/1973 | Hou | 423/447.1 |
| 3,961,888 | 6/1976 | Riggs | 8/115.5 |
| 4,251,589 | 2/1981 | Romaniec | 423/447.1 |
| 4,285,831 | 8/1981 | Yoshida et al. | 423/447.2 |
| 4,444,574 | 4/1984 | Trudewell | 428/367 |
| 4,473,372 | 9/1984 | Kuder et al. | 8/115.51 |
| 4,643,931 | 2/1987 | McCullough et al. | 428/367 |
| 4,756,941 | 7/1988 | McCullough et al. | 428/367 |

FOREIGN PATENT DOCUMENTS

| | | | |
|---|---|---|---|
| 1300239 | 12/1972 | United Kingdom | 423/447.1 |
| 1352141 | 5/1974 | United Kingdom | 423/447.1 |
| 2152541 | 8/1985 | United Kingdom | 428/367 |

*Primary Examiner*—John Doll
*Assistant Examiner*—Robert M. Kunemund
*Attorney, Agent, or Firm*—Burns, Doane, Swecker & Mathis

[57] ABSTRACT

Partially carbonized polymeric fibrous materials heretofore available have been observed to exhibit unstable electrical resistivity values upon exposure to ambient conditions with such values substantially increasing upon the passage of time. In accordance with the concept of the present invention the previously prepared partially carbonized polymeric fibrous materials (as described) are subjected to heating at a temperature of approximately 180° to 450° C. (preferably approximately 240° to 360° C.) in an atmosphere containing molecular oxygen for an extended period of time (as described) wherein the quantity of bound oxygen present therein is substantially increased, the electrical resistivity is increased, and the stability of the resulting electrical resistivity is substantially enhanced. The resulting partially carbonized polymeric fibrous material is particularly suited for use in applications where it serves as an electrostatic charge dissipater or as shielding for electromagnetic radiation.

10 Claims, 2 Drawing Sheets

PARTIALLY CARBONIZED POLYMERIC FIBROUS MATERIAL HAVING AN ELECTRICAL RESISTIVITY OF ENHANCED STABILITY

This application is a division of application Ser. No. 786,863, filed Oct. 11, 1985, now U.S. Pat. No. 4,816,242.

BACKGROUND OF THE INVENTION

Partially carbonized polymeric fibrous materials are known in the prior art and commonly are formed by the thermal processing of a polymeric fibrous material wherein the maximum carbonization temperature utilized is less than that employed for the production of true carbon fibers which contain at least 90 percent carbon by weight. For instance, a maximum carbonization temperature in a non-oxidizing atmosphere of approximately 600° to 1150° C. commonly is employed when forming a partially carbonized polymeric fibrous material while a maximum temperature of 1300° C. or more commonly is employed when forming carbon fibers containing at least 90 percent carbon by weight. While heating in a non-oxidizing atmosphere, elements other than carbon such as oxygen substantially are evolved and a backbone of carbon atoms is formed which provides a route for electron movement. Generally the higher the maximum carbonization temperature, the lower the electrical resistivity of the resulting fibrous product in the direction of its length.

The partially carbonized polymeric fibrous materials heretofore available, while holding potential for utilization in a number of end uses, have been observed to exhibit highly unstable electrical properties when exposed to ambient conditions. Accordingly, it has been observed that the electrical resistivity of a partially carbonized polymeric material will increase significantly upon exposure to an unprotected environment (e.g., to ambient conditions). The change (i.e., increase) in electrical resistivity commonly is the greatest for those partially carbonized polymeric fibrous materials which were formed at the lower end of the temperature range heretofore specified. It has been observed that such increase in electrical resistivity upon the passage of time will still be operative after two years of aging at ambient conditions.

When the partially carbonized polymeric fibrous materials of the prior art are selected for end use applications where the electrical properties are of importance (e.g., for electrostatic charge dissipation or for electromagnetic radiation shielding), the change in resistivity over time greatly complicates inventory maintenance and the service reliability of the product. Accordingly, the change in electrical resistivity with time must be factored into the design of the product or the product must be periodically replaced when its changing electrical resistivity moves outside of the prescribed specifications for a given end use.

For a discussion of the decrease in electrical conductivity upon aging in air of partially carbonized fibers derived from acrylic fibers see "Electrical Conductivity and Electro-Spin Resonance in Oxidatively Stabilized Polyacrylonitrile Subjected to Elevated Temperature," by N. R. Lerner, *J. Appl. Phys.* 52(11), November 1981, pages 6757 to 6762.

It is an object of the present invention to provide an improved process for the production of a partially carbonized polymeric fibrous material having an electrical resistivity of enhanced stability.

It is an object of the present invention to provide an improved partially carbonized polymeric fibrous material which exhibits an electrical resistivity of enhanced stability.

It is another object of the present invention to provide a process for adjusting the electrical resistivity of a partially carbonized polymeric fibrous material to a value which thereafter exhibits an enhanced electrical stability when compared to a similarly prepared fibrous material of substantially the same electrical resistivity which was not subject to step (b) of the present process.

It is a further object of the present invention to provide an improved partially carbonized polymeric fibrous material which particularly is suited for use in applications involving electrostatic charge dissipation or shielding for electromagnetic radiation.

These and other objects, as well as the scope, nature, and utilization of the claimed invention will be apparent to those skilled in the art from the following detailed description and appended claims.

SUMMARY OF THE INVENTION

It has been found that an improved process for forming a partially carbonized polymeric fibrous material which exhibits an electrical resistivity of enhanced stability upon exposure to ambient conditions comprises:

(a) selecting a partially carbonized polymeric fibrous material having a carbon content of approximately 66 to 86 percent by weight and a bound oxygen content of approximately 1 to 12 percent by weight, with said carbon and bound oxygen contents being based upon the sum of the weights of carbon, bound oxygen, nitrogen and hydrogen present therein; and (b) subjecting the partially carbonized polymeric fibrous material to an atmosphere containing heated molecular oxygen at a temperature of approximately 180° to 450° C. for at least one hour whereby the bound oxygen content of the partially carbonized polymeric fibrous material is raised at least 15 percent by weight to yield a fibrous product of increased electrical resistivity which exhibits an electrical resistivity in the direction of its length within the range of approximately 0.01 to 10,000,000 ohm-cm. which better withstands an increase in electrical resistivity upon exposure to ambient conditions than a similarly prepared fibrous material of substantially the same electrical resistivity which was not subject to step (b).

A partially carbonized polymeric fibrous material which exhibits an electrical resistivity of enhanced stability upon exposure to ambient conditions is provided.

In a preferred embodiment a partially carbonized polymeric material is provided having an electrical resistivity of enhanced stability when exposed to ambient conditions formed by the thermal processing of an acrylic fibrous material selected from the group consisting of an acrylonitrile homopolymer and an acrylonitrile copolymer containing at least 85 mole percent of recurring acrylonitrile units and up to 15 mole percent of one or more monovinyl units, and the following combination of characteristics:

(a) a denier per filament of approximately 0.2 to 2.0, (b) a carbon content of approximately 63 to 85 percent by weight, (c) bound oxygen content of approximately 2.3 to 14 percent by weight, (d) a nitrogen content of approximately 10 to 22 percent by weight, (e) a hydrogen content of less than 3 percent by weight, (f) a tensile strength of at least approximately 50,000 psi, (g) a tensile modulus of approximately 2,500,000 to 25,000,000 psi, (h) a surface which is substantially free of pitting when examined with a scanning electron microscope at a magnification of 6000X, and (i) an electrical resistivity in the direction of its length within the range of approximately 0.01 to 10,000,000 ohm-cm, with said carbon, bound oxygen, nitrogen and hydrogen contents being based upon the sum of the weights of carbon, bound oxygen, nitrogen and hydrogen present therein.

BRIEF DESCRIPTION OF THE THE DRAWINGS

FIG. 1 is a photograph which illustrates the surface appearance of several typical partially carbonized fibers formed in accordance with a preferred embodiment of the present invention. The photograph was obtained by use of a scanning electron microscope at a magnification of 6000X and shows the fiber surface to be substantially free of pitting when so observed.

FIG. 2 is a graphical presentation of electrical resistivity data from Table I and Table II which which follow. Line I presents prior art data from Table I which illustrates the percent increase in electrical resistivity after 2880 hours at ambient conditions. Line II presents data from Table II which illustrates the electrical resistivity of enhanced stability when the partially carbonized fibrous material of the present invention is exposed to the same conditions.

DESCRIPTION OF PREFERRED EMBODIMENTS

The Starting Material

Figure 1:
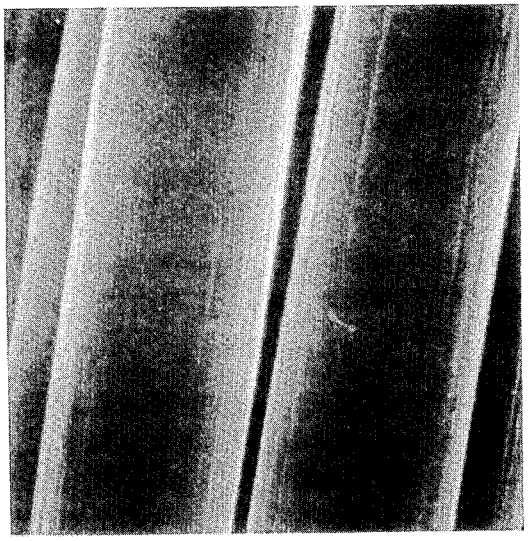
Figure 2:
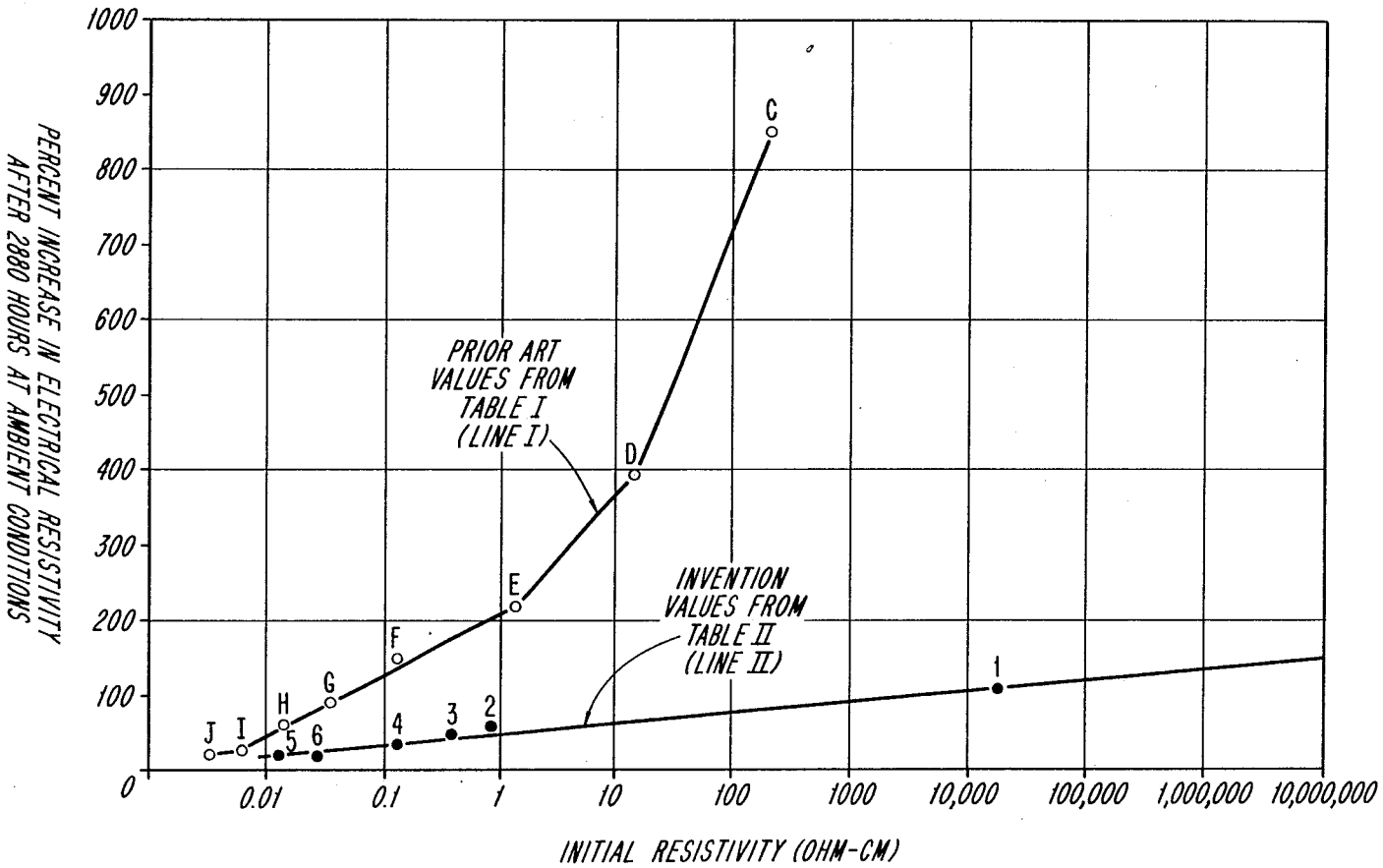

The starting material selected for use in the present invention is a partially carbonized polymeric fibrous material having a carbon content of approximately 66 to 86 percent by weight (e.g., approximately 68 to 84 percent by weight) and a bound oxygen content of approximately 1 to 12 percent by weight (e.g., approximately 2 to 12 percent by weight or approximately 2 to 8 percent by weight). As discussed hereafter, the carbon and bound oxygen contents are based upon the sum of the weights of carbon, bound oxygen, nitrogen and hydrogen present therein. However, there is no requirement that the starting material contain appreciable quantities of nitrogen and hydrogen. The carbon content of the starting material is essentially amorphous in nature when subjected to standard x-ray diffraction analysis.

As will be apparent to those skilled in the art of carbon fiber formation, the fibrous starting material can be obtained through the thermal processing of a polymeric fibrous material while retaining the original fibrous configuration of the polymeric fibrous material substantially intact. For many polymeric fibrous materials a thermal stabilization step at moderate temperatures commonly is initially employed at a temperature of approximately 180° to 400° C. (e.g., 200° to 300° C.) prior to carrying out the step in which partial carbonization is achieved. Preferably the thermal stabilization treatment is carried out while the fibrous material is under longitudinal tension. Suitable thermal stabilization atmospheres include air with the exact temperature selected being influenced by the ability of the polymeric fibrous material to withstand elevated temperatures without loss of the original fibrous configuration. Thermal stabilization conditions can be selected which correspond to those commonly employed for carbon fiber production. During the thermal stabilization reaction an oxidative cross-linking reaction commonly occurs with the polymeric fibrous material being rendered black in appearance and better able to withstand the partial carbonization treatment which follows without loss of its original fibrous configuration.

The partial carbonization step is carried out in a non-oxidizing atmosphere under conditions wherein elements other than carbon are substantially evolved to yield a partially carbonized fibrous material having the specified carbon content and bound oxygen content as determined by standard elemental analysis procedures. Typical non-oxidizing atmospheres in which the partial carbonization can be carried out to form the starting material include nitrogen, argon, helium, etc. The maximum carbonization temperature utilized greatly influences the extent of the carbonization reaction and commonly is in the range of approximately 600° to 1150° C. (e.g., approximately 650° to 1050° C.). It is preferred that the fibrous material be under longitudinal tension during the thermal processing which accomplishes partial carbonization. Two minutes or less residence time at the maximum carbonization temperature commonly is sufficient. Care is taken not to carbonize the fibrous material above the specified carbon content, and below the specific bound oxygen content through the adjustment of the maximum carbonization temperature and the residence time at the maximum carbonization temperature.

The carbon content and the bound oxygen content (heretofore specified) for the starting material can be determined using a standard elemental analyzer, such as a Perkin Elmer Model No. 240B elemental analyzer while operating in accordance with the manufacturer's instructions. Prior to the analysis the fibrous samples can be present at ambient conditions (e.g., 72° F. and 50 percent relative humidity), and while present in the elemental analyzer subjected to combustion at 1000° C. for approximately 5 minutes with the analysis being programmed for a total analysis time of 15 minutes.

The polymeric fibrous materials from which the partially carbonized polymeric fibrous material can be derived generally are those polymeric fibrous materials which are suitable for use as precursors in the formation of carbon fibers. Representative polymeric fibrous materials which may serve this role are acrylics, cellulosics (including rayon), polyamides, polybenzimidazoles, etc. A preferred polymeric fibrous material is an acrylic fibrous material which is either an acrylonitrile homopolymer or acrylonitrile copolymer containing at least 85 mole percent of acrylonitrile units and up to 15 mole percent of one or more monovinyl units. Representative monovinyl units for inclusion in such copolymers are styrene, methyl acrylate, methyl methacrylate, vinyl acetate, vinyl chloride, vinylidene chloride, vinyl pyridine, and the like. A particularly preferred acrylonitrile copolymer contains at least 95 mole percent of acrylonitrile units and up to 5 mole percent of one or more monovinyl units. Representative polyamides are wholly aromatic in nature and include polyparabenzimide and polyparaphenyleneterephthalamide. Polyparabenzamide and processes for preparing the same are disclosed in U.S. Pat. Nos. 3,109,836; 3,225,011; 3,541,056; 3,542,719; 3,547,895; 3,558,571; 3,575,933; 3,600,350; 3,671,542; 3,699,085; 3,753,957; and 4,025,494. Polyparaphenyleneterephthalamide, which is available commercially from DuPont under the trademark KEVLAR, and processes of preparing the same are disclosed in U.S. Pat. Nos. 3,006,899; 3,063,966; 3,094,511; 3,232,910; 3,414,645; 3,673,143; 3,748,299; 3,836,498; and 3,827,998. A preferred polybenzimidazole is poly-2,2'-(m-phenylene)-5,5'-bibenzimidazole, and is discussed in U.S. Pat. No. 3,174,947 and U.S. Reissue Pat. No. 26,065.

Representative processes which can be adapted to carry out the required partial carbonization are disclosed in U.S. Pat. Nos. RE 30,414; 3,285,696; and 3,497,318; and U.K. Patent Nos. 911,542 and 1,370,366.

The partially carbonized polymeric fibrous material commonly assumes the configuration of a multifilamentary fibrous material. For instance, the fibrous material may assume the configuration of a multifilamentary yarn, tow, or strand, or a cloth (e.g., a woven cloth) which incorporates the same. Alternatively, staple fibers and articles formed from the same (e.g., papers, non-woven cloths, etc.) may be selected. In a preferred embodiment the partially carbonized polymeric fibrous material comprises approximately 1,000 to 12,000 substantially continuous filaments which are generally aligned in a substantially parallel relationship. Such filaments optionally may be entangled with numerous cross-over points. The individual fibers of the partially carbonized polymeric material commonly possess a denier of approximately 0.2 to 2.0, (e.g., 0.3 to 0.7), however fibers of smaller or larger denier likewise may be selected.

The Enhancement of the Electrical Stability

The heretofore described partially carbonized polymeric fibrous material is next heated in an atmosphere containing molecular oxygen at a relatively mild temperature (when compared to the carbonization temperature) for an extended period of time which has been found to have a substantial beneficial influence upon the electrical stability of the same.

The partially carbonized polymeric fibrous material is subjected to an atmosphere containing heated molecular oxygen at a temperature of approximately 180° to 450° C. (e.g., approximately 180° to 400° C.) for at least one hour whereby the bound oxygen content of the partially carbonized polymeric fibrous material is raised at least 15 percent by weight.

It is not essential that the heated atmosphere in which the partially carbonized polymeric fibrous material is treated consist solely of molecular oxygen. For instance, ordinary air or a mixture of molecular oxygen and a non-reactive or inert gas may form the heated atmosphere. Generally the lesser the concentration of molecular oxygen in the heated atmosphere the longer the residence time required to achieve the requisite increase in bound oxygen within the partially carbonized polymeric fibrous material.

The residence time in the atmosphere containing heated molecular oxygen also will be influenced by the temperature of the atmosphere with the higher temperatures within the range specified requiring a lesser residence time. In a preferred embodiment the atmosphere containing the heated molecular oxygen is provided at a temperature of approximately 240° to 360° C. If the temperature of the atmosphere is much above 400° C., there is a tendency for the fiber surface to undergo undesirable pitting and significant loss of weight and/or mechanical properties. In a preferred embodiment at the conclusion of step (b) the partially carbonized polymeric fibrous material is substantially free of pitting on its surface when examined with a scanning electron microscope at a magnification of 6000X. See the accompanying photograph for the appearance of typical fibers formed in accordance with the present invention. Representative residence times in the atmosphere containing the heated molecular oxygen commonly range from 1 to 500 hours, or more (e.g., 2 to 48 hours). When operating at temperature in the range of approximately 240° to 360° C., a residence time of approximately 2 to 24 hours commonly is selected while employing an air atmosphere.

The partially carbonized polymeric material while present on an appropriate support may be simply placed in an oven through which the heated molecular oxygen circulates. For instance, a continuous length of the fibrous material may be wound on a perforated heat-resistant support and placed in a circulating air oven. Alternatively, a continuous length of the partially carbonized polymeric material may continuously be passed in the direction of its length through the heated atmosphere.

While present in the atmosphere of heated molecular oxygen, it is essential that the bound oxygen content of the fibrous material increases at least 15 percent by weight (e.g., approximately 20 to 200 percent by weight). In a particularly preferred embodiment the bound oxygen content is increased approximately 20 to 100 percent by weight (e.g., approximately 20 to 50 percent by weight). Such increase in bound oxygen under the reaction conditions specified will occur throughout the cross-section of the fibrous materials; however, there will tend to be a greater concentration of bound oxygen molecules near the fiber surface as determined by electron spectroscopy for chemical analysis. For instance, approximately 25 to 30 percent by weight bound oxygen commonly will be present within the outer 100 Angstrom units of the fiber surface in addition to substantial bound oxygen throughout the fiber interior with the overall bound oxygen content of the fibrous material being approximately 1.3 to 14 percent by weight (e.g., approximately 2.3 to 14 percent by weight or approximately 3.5 to 9 percent by weight). The pickup of bound oxygen by the partially carbonized polymeric fibrous material which is carried out in step (b) of the present process is dissimilar to the less rigorous carbon fiber surface treatments heretofore accomplished in the prior art whereby the surfaces and to a lesser degree the interior portions of such carbon fibers of greater carbon content are oxidized to some extent in order to promote better adhesion to a resinous matrix material. For instance, the outer 100 Angstrom units of fiber surface of a typical surface treated carbon fiber which was prepared at a maximum carbonization temperature of 1300° C. typically will contain approximately 10 to 15 percent bound oxygen by weight with the overall bound oxygen content being well below 1 percent by weight (e.g., 0.5 to 0.6 percent by weight). Representative prior processes in which carbon fibers have been oxidatively surface treated are disclosed in U.S. Pat. Nos. 3,476,703; 3,660,140; 3,723,150; 3,723,607; 3,745,104; 3,754,957; 3,859,187; 3,894,884; and 4,374,114. Heretofore, in the prior art there has been no need to oxidatively surface treat a partially carbonized polymeric fibrous material since such fibrous material inherently adheres well to a resinous matrix material without modification. Also, the carbon fibers of the prior art which have been subjected to an oxidative surface treatment exhibit substantially lower electrical resistivity values than the partially carbonized polymeric materials of the present invention. The carbon content of the partially carbonized polymeric fibrous material continues to exhibit an essentially amorphous nature when subjected to standard x-ray diffraction analysis following step (b) of the present process.

The theory whereby the electrical resistivity of the partially carbonized polymeric material is rendered more stable upon exposure to ambient conditions is considered to be complex and incapable of simple explanation. It is believed, however, that free radicals present within the partially carbonized polymeric material may react with the molecular oxygen during step (b) and such radicals thereafter are no longer available to undergo a deleterious aging reaction whereby the electrical resistivity is substantially increased upon exposure to ambient conditions. Also, as the oxygen molecules become chemically bound within the fibrous material, electrically conductive pathways present within the fibrous material are destroyed to some extent. Accordingly, step (b) of the present process causes some rise in the electrical resistivity of the partially carbonized polymeric fibrous material. When practicing the process of the present invention, one initially selects a partially carbonized polymeric fibrous material having an electrical resistivity below that desired in the final product following step (b) in order to compensate for the rise in electrical resistivity resulting from the substantial bound oxygen increase which is accomplished in step (b).

At the conclusion of step (b) the partially carbonized polymeric fibrous material exhibits an electrical resistivity in the direction of its length within the range of approximately 0.01 to 10,000,000 ohm-cm. (e.g., 0.04 to 150,000 ohm-cm. or 0.04 to 100,000 ohm-cm.) when measured at room temperature (i.e., 25° C.). In a particularly preferred embodiment wherein a product of higher conductivity is desired the electrical resistivity of the product is within the range of approximately 0.04 to 2.0 ohm-cm. at the conclusion of step (b). In another particularly preferred embodiment wherein a product of lower conductivity is desired for static dissipation applications, the electrical resistivity of the product is within the range of approximately 50,000 to 5,000,000 ohm-cm. The fibrous product formed by the process of the present invention exhibits an increased electrical resistivity and better withstands a further increase in electrical resistivity upon exposure to ambient conditions than a similarly prepared fibrous material of substantially the same electrical resistivity which was not subject to step (b). In other words, when one compares the product of the present invention to a partially carbonized polymeric fibrous material derived from the same polymeric fibrous material which was partially carbonized under similar conditions (i.e., usually a slightly lower maximum partial carbonization temperature) to achieve substantially the same resistivity prior to step (b) as the product of the present invention following step (b), the product of the present invention will invariably exhibit a more stable electrical resistivity upon exposure to ambient conditions. It should be understood however that fibrous products which posses an electrical resistivity at the upper end of the specified range will tend to exhibit more change in electrical resistivity upon the passage of time than those products formed at the lower end of the electrical resistivity range. However, the present invention nevertheless provides a substantial improvement for any given level of electrical resistivity within the range specified.

The electrical resistance of the fibrous material in the direction of its length conveniently can be determined at room temperature (i.e., 25° C.) by use of a standard ohmmeter. A conductive silver paste can be placed upon each end of the fibrous material to insure good electrical contact while undergoing testing. For instance, a 10 cm. length of multifilamentary product conveniently can be tested using a Fluke Model No. 8024B multimeter (ohmmeter). Other suitable equipment includes a Keithley Model No. 247 D.C. power supply, a Keithley Model No. 616 digital electrometer, etc. The electrical resistivity is calculated by multiplying the fiber resistance/cm. by the fiber cross-sectional area.

In a particularly preferred embodiment the partially carbonized polymeric fibrous material is derived from an acrylic fibrous material which is either an acrylonitrile homopolymer or copolymer as previously described, and following step (b) has an electrical resistivity of enhanced stability when exposed to ambient conditions and exhibits a denier per filament of approximately 0.2 to 2.0 (e.g., 0.3 to 0.7), a carbon content of approximately 63 to 85 percent by weight (e.g., approximately 68 to 85 percent by weight), a bound oxygen content of approximately 1.3 to 14 percent by weight (e.g., approximately 2.3 to 14 percent by weight), a nitrogen content of approximately 10 to 22 percent by weight, a hydrogen content of less than 3 percent by weight (e.g., approximately 0.5 to 2.5 percent by weight), a tensile strenght of at least approximately 50,000 psi (e.g., approximately 100,000 to 400,000 psi), and a tensile modulus of approximately 2,500,000 to 25,000,000 psi. The tensile strength and tensile modulus values conveniently can be determined in accordance with the standard ASTM D-4018 procedure.

The improved fibrous product of the present invention may be used to advantage in those electrical applications where a semiconductor having an electrical resistivity of enhanced stability is desirable. For instance, the improved fibrous material may be employed in applications where it serves as an electrostatic charge dissipater or as shielding for electromagnetic radiation. The improved fibrous product may be used without an external protective coating when used as an electrostatic charge dissipater or may be incorporated in a resinous matrix material (e.g., an epoxy resin) when used to shield or absorb electromagnetic radiation.

The following Examples are presented as specific illustrations of the present invention. It should be understood, however, that the invention is not limited to the specific details set forth in the Examples.

EXAMPLES

An acrylic multifilamentary tow was thermally stabilized, samples thereof were partially carbonized while employing various maximum carbonization temperatures (as indicated hereafter), and samples of some of the partially carbonized fibrous materials were subjected to electrical stability enhancing treatments of the present invention. Also, as described hereafter, the electrical resistivities without and with the electrical stability enhancing treatments were measured in the direction of the fiber length to confirm the improved electrical stability made possible by the present invention.

The acrylic multifilamentary tow was an acrylonitrile copolymer of approximately 6,000 substantially parallel substantially continuous filaments consisting of approximately 98 mole percent of acrylonitrile units and approximately 2 mole percent of methylacrylate units. The multifilamentary tow following spinning was drawn to increase its orientation, and possessed a total denier of approximately 5,400, and a denier per filament of approximately 0.9.

The thermal stabilization of the acrylonitrile copolymer multifilamentary tow was conducted by passing the tow in the direction of its length through a heated circulating air oven. The multifilamentary tow was substantially suspended in the circulating air oven when undergoing thermal stabilization and was directed along its course by a plurality of rollers. While present in such circulating air oven, the multifilamentary tow was heated in the range of 200° to 300° C. for approximately one hour to render the fibers black in appearance and capable of withstanding the partial carbonization reaction.

Sections of the thermally stabilized acrylonitrile copolymer designated A through J next were partially carbonized while employing maximum carbonization temperatures of 650° C., 690° C., 750° C., 800° C., 850° C., 900° C., 950° C., 1000° C., 1050° C., and 1100° C. In each instance, segments of the thermally stabilized acrylonitrile copolymer tow was passed in the direction of their length through an electrical resistance furnace provided with a heated circulating nitrogen atmosphere. The multifilamentary tow was present in such furnace for approximately 2 minutes and was heated at the maximum carbonization temperature for approximately 30 seconds.

The resistivity of each segment was determined (1) as soon as practicable following partial carbonization (i.e., to obtain the initial resistivity), (2) after approximately 1,000 hours following partial carbonization and continuous exposure to ambient conditions, and (3) after approximately 2,880 hours following partial carbonization and continuous exposure to ambient conditions. The electrical resistance determinations were made at room temperature (i.e., at approximately 25° C.) employing a Fluke Model No. 8024B multimeter (ohmmeter) and 10 cm. fiber sections which were mounted within the test equipment using electrically conductive silver paint. The resistivity was calculated by multiplying the observed resistance per cm. by the fiber cross-sectional area, and the fiber cross-sectional area was calculated from the denier and the density of a completely dry sample.

The electrical resistivity characteristics for these partially carbonized polymeric fibrous materials A through J (which are representative of the prior art) are reported in Table I hereafter. The carbon and bound oxygen contents were determined as heretofore described and are based upon the sum of the weights of carbon, bound oxygen, nitrogen, and hydrogen present therein.

TABLE I (The Prior Art)

| Sample Identification | Maximum Carbonization Temperature | Carbon Content Following Partial Carbonization (% by weight) | Bound Oxygen Content Following Partial Carbonization (% by weight) | Initial Resistivity (ohm-cm.) | Increase in Resistivity After 1000 hours (%) | Increase in Resistivity After 2880 hours (%) |
|---|---|---|---|---|---|---|
| A | 650° C. | 69.9 | 7.1 | 37,000 | 1,076 | NA |
| B | 690° C. | 71.4 | 6.0 | 3,400 | 904 | NA |
| C | 750° C. | 72.8 | 6 0 | 277 | 550 | 848 |
| D | 800° C. | 73.5* | 5.4* | 16.7 | 249 | 394 |
| E | 850° C. | 74.2 | 4.8 | 1.69 | 145 | 219 |
| F | 900° C. | 75.4 | 4.7 | 0.160 | 104 | 147 |
| G | 950° C. | 76.4 | 5.0 | 0.06 | 74 | 97 |
| H | 1,000° C. | 78.0 | 4.9 | 0.022 | 51 | 60 |
| I | 1,050° C. | 80.9 | 3.8 | 0.0081 | 18 | 24 |
| J | 1,100° C. | 86* | 2* | 0.0052 | 15 | 20 |

* = estimated value
NA = not available

The foregoing data illustrates the nature of the electrical instability commonly exhibited by partially carbonized polymeric fibrous materials of the prior art. It will be noted that those fibers formed at the lower carbonization temperatures tend to exhibit the higher electrical resistivities and the greatest resistivity instability when exposed to ambient conditions for extended periods of time.

In order to exemplify the increased electrical stability made possible by the present invention similarly prepared samples of the partially carbonized polymeric fibrous material designated 1 through 6 were wound on perforated steel spools and were placed in a BLUE M oven containing a heated circulating air atmosphere provided at various temperatures (as indicated hereafter) for extended periods of time (as indicated hereafter). While present in the heated air atmospheres, the bound oxygen content of the partially carbonized fibrous material was substantially increased. The electrical resistivity values were determined in the manner previously discussed, and the characteristics of the product are reported in Table II hereafter. The initial resistivity there reported was determined immediately following the air treatment. The carbon and bound oxygen contents are average values which were determined as heretofore described and are based upon the sum of the weights of carbon, bound oxygen, nitrogen, and hydrogen present therein.

TABLE II

| Example Number | Maximum Carbonization Temperature | Average Carbon Content Following Partial Carbonization (% by weight) | Average Bound Oxygen Content Following Partial Carbonization (% by weight) | (The Invention) Air Treatment | Average Carbon Content Following Air Treatment (% by weight) | Average Bound Oxygen Content Following Air Treatment (% by weight) | Initial Resistivity (ohm cm.) | Increase in Resistivity After 1000 hrs. (%) | Increase in Resistivity After 2880 hr (%) |
|---|---|---|---|---|---|---|---|---|---|
| 1 | 750° C. | 72.8 | 6.0 | 260° C. 8 hrs. | 70.1 | 8.7 | 31,600 | 80 | 107 |
| 2 | 950° C. | 76.4 | 5.0 | 260° C. 30 hrs. | 74.1 | 7.3 | 0.920 | 38 | 56 |
| 3 | 950° C. | 76.4 | 5.0 | 260° C. 24 hrs. | 74.3 | 6.8 | 0.637 | 38 | 49 |
| 4 | 1,000° C. | 78.0 | 4.9 | 280° C. 28 hrs. | 75.9 | 6.7 | 0.159 | 31 | 36 |
| 5 | 1,050° C. | 80.9 | 3.8 | 280° C. 28 hrs. | 80.1 | 4.8 | 0.018 | 18 | 23 |
| 6 | 1,050° C. | 80.9 | 3.8 | 285° C. 48 hrs. | 77.8 | 6.7 | 0.050 | NA | 21 |

NA = not available

It will be noted that the heated air treatment of the partially carbonized polymeric material results in an increase in the electrical resistivity. For instance, compare the initial resistivities of Sample C and Example 1, Sample G and Examples 2 and 3, Sample H and Example 4, and Sample I and Examples 5 and 6. Also, there was a significant increase in the bound oxygen content of 45 percent for Example 1, 46 percent for Example 2, 36 percent for Example 3, 37 percent for Example 4, 26 percent for Example 5, and 76 percent for Example 6.

It additionally is apparent that the products of the invention better withstand an increase in electrical resistivity upon exposure to ambient conditions than a similarly prepared fibrous material of substantially the same electrical resistivity which was not subject to step (b). For instance, Sample A exhibited substantially the same initial electrical resistivity as Example 1; however, the electrical resistivity of Sample A was over ten times less stable than that of Example 1. Also, Sample F exhibited substantially the same initial electrical resistivity as Example 4; however, the electrical resistivity of Sample F was over three times less stable than that of Example 4. A similar comparison can be made between Sample G and Example 6.

Although the invention has been described with preferred embodiments, it is to be understood that variations and modifications may be resorted to as will be apparent to those skilled in the art. Such variations and modifications are to be considered within the purview and scope of the claims appended hereto.

We claim:

1. A partially carbonized polymeric fibrous material having an electrical resistivity of enhanced stability when exposed to ambient conditions formed by the thermal processing of an acrylic fibrous material selected from the group consisting of an acrylonitrile homopolymer and an acrylonitrile copolymer containing at least 85 mole percent of recurring acrylonitrile units and up to 15 mole percent of one or more monovinyl units and possessing the following combination of characteristics:

(a) a denier per filament of approximately 0.2 to 2.0,
(b) a carbon content of approximately 63 to 85 percent by weight,
(c) a bound oxygen content of approximately 2.3 to 14 percent by weight,
(d) a nitrogen content of approximately 10 to 22 percent by weight,
(e) a hydrogen content of less than 3 percent by weight,
(f) a tensile strength of at least approximately 50,000 psi,
(g) a tensile modulus of approximately 2,500,000 to 25,000,000 psi,
(h) a surface which is substantially free of pitting when examined with a scanning electron microscope at a magnification of 6000X, and
(i) an electrical resistivity in the direction of its length within the range of approximately 0.01 to 10,000,000 ohm-cm, with said carbon, bound oxygen, nitrogen and hydrogen contents being based upon the sum of the weights of carbon, bound oxygen, nitrogen and hydrogen present therein and wherein said electrical resistivity of enhanced stability is evidenced by an increase in the initial resistivity following 2880 hours at ambient conditions to no more than a value which approximates a point on Line II of the drawing corresponding to the initial resistivity.

2. A partially carbonized polymeric fibrous material having an electrical resistivity of enhanced stability according to claim 1 which is derived from an acrylonitrile homopolymer or an acrylonitrile copolymer containing at least 95 mole percent of recurring acrylonitrile units and up to 5 mole percent of one or more monovinyl units.

3. A partially carbonized polymeric fibrous material having an electrical resistivity of enhanced stability according to claim 1 having a denier per filament of approximately 0.3 to 0.7.

4. A partially carbonized polymeric fibrous material having an electrical resistivity of enhanced stability according to claim 1 having a carbon content 68 to 85 percent by weight.

5. A partially carbonized polymeric fibrous material having an electrical resistivity of enhanced stability according to claim 1 having a hydrogen content of approximately 0.5 to 2.5 percent by weight.

6. A partially carbonized polymeric fibrous material having an electrical resistivity of enhanced stability according to claim 1 which exhibits a tensile strength of 100,000 to 400,000 psi.

7. A partially carbonized polymeric fibrous material having an electrical resistivity of enhanced stability according to claim 1 which exhibits an electrical resistivity in the direction of its length within the range of approximately 0.04 to 150,000 ohm-cm.

8. A partially carbonized polymeric fibrous material having an electrical resistivity of enhanced stability according to claim 1 which exhibits an electrical resistivity in the direction of its length within the range of approximately 0.04 to 100,000 ohm-cm.

9. A partially carbonized polymeric fibrous material having an electrical resistivity of enhanced stability according to claim 1 which exhibits an electrical resistivity in the direction of its length within the range of approximately 0.04 to 2.0 ohm-cm.

10. A partially carbonized polymeric fibrous material having an electrical resistivity of enhanced stability according to claim 1 which exhibits an electrical resistivity in the direction of its length within the range of approximately 50,000 to 5,000,000 ohm-cm.

* * * * *